United States Patent [19]

Kobayashi et al.

[11] Patent Number: 4,615,184

[45] Date of Patent: Oct. 7, 1986

[54] COMPRESSION REFRIGERATING MACHINE WITH VAPOR-LIQUID SEPARATOR

[75] Inventors: Satoru Kobayashi; Shigeo Sugimoto; Masatosi Terasaki, all of Ibaraki, Japan

[73] Assignee: Hitachi, Ltd., Tokyo, Japan

[21] Appl. No.: 799,975

[22] Filed: Nov. 20, 1985

[30] Foreign Application Priority Data

Nov. 22, 1984 [JP] Japan ..... 59-245956
Feb. 13, 1985 [JP] Japan ..... 60-24321

[51] Int. Cl.[4] ..... F25B 43/00

[52] U.S. Cl. ..... 62/512; 62/285; 62/509

[58] Field of Search ..... 62/512, 509, 285

[56] References Cited

U.S. PATENT DOCUMENTS

| | | | |
|---|---|---|---|
| 1,694,370 | 12/1928 | Burdick | 62/512 |
| 2,550,428 | 4/1951 | Reid, Jr. | 62/512 |
| 3,481,151 | 12/1969 | Seeley | 62/512 |
| 3,553,974 | 1/1971 | Osborne | 62/512 |
| 3,589,140 | 6/1971 | Osborne | 62/197 |
| 3,678,993 | 7/1972 | Pierce | 62/285 |
| 3,744,273 | 7/1973 | Ware | 62/512 |
| 3,848,425 | 11/1974 | Watkins | 62/512 |
| 4,226,089 | 10/1980 | Barrow | 62/512 |
| 4,476,695 | 10/1984 | Epps | 62/512 |

*Primary Examiner*—Ronald C. Capossela
*Attorney, Agent, or Firm*—Antonelli, Terry & Wands

[57] ABSTRACT

Disclosed is a compact compressor refrigerating machine, particularly a turbo-refrigerating machine which uses a turbocompressor, having a motor, a set-up gear, a compressor, a condenser, a pressure reducing means, and an evaporator. A vapor-liquid separator having a first opening on the bottom wall thereof and second and third openings on the side wall thereof is installed on the evaporator in such a manner that the vapor-liquid separator communicates with the evaporator through the first opening. The compressor is connected to the side wall of the vapor-liquid separator so as to communicate the second opening with the suction passage of the compressor and the third opening with the discharge passage of the compressor, respectively. A separation element is disposed in the vapor-liquid separator so as to cross the flow of the refrigerant vapor which flows from the first opening toward the second opening.

15 Claims, 10 Drawing Figures

COMPRESSION REFRIGERATING MACHINE WITH VAPOR-LIQUID SEPARATOR

BACKGROUND OF THE INVENTION

This invention relates to a refrigerating machine having a vapor-liquid separator for removing droplets which are mixed into refrigerating gas, and suitable as a compressor refrigerating machine, especially a refrigerating machine using a centrifugal compressor.

DESCRIPTION OF THE PRIOR ART

A compression refrigerating machine using as its compressor a centrifugal compressor and having a condenser, an expanding means and an evaporator is disclosed in U.S. Pat. No. 3,589,140. In the refrigerator according to this Patent, an eliminator is provided to separate and remove the droplets of a refrigerant which are produced at the time of evaporation of the refrigerant and suspended in the refrigerant vapor evaporated by the evaporator.

However, this structure in which the eliminator is disposed within the shell of the evaporator requires the eliminator to be installed sufficiently apart from the surface of the refrigerant liquid in the shell of the evaporator for the droplets flying from the surface of the refrigerant liquid to be prevented from adhering to the eliminator, and also requires a sufficient distance to be maintained between the eliminator and the upper wall of the evaporator to minimize as much as possible the speed at which the refrigerant vapor passes the eliminator, thereby to pass the refrigerant vapor over the entire area as uniformly as possible. Therefore it is necessary to make the shell of the evaporator high. If the shell of the evaporator is made low, a phenomenon called "mist-up" occurs, in which the droplets of the refrigerant vapor pass the evaporator and are sucked by the compressor. As a result, the cooling refrigerant vapor is taken out of the evaporator, adversely affecting cooling capacity, corrosion of the compressor due to the impact of the droplets, or damage to the impeller.

SUMMARY OF THE INVENTION

Accordingly, it is an object of the present invention to provide a compressor refrigerator having a vapor-liquid separator which is capable of shortening the distance between the surface of refrigerant liquid in an evaporator and the upper wall of the shell of the evaporator.

It is another object of the present invention to provide a compressor refrigerator having a vapor-liquid separator which is capable of shortening the distance between the plane in which the separator is installed and its highest position.

It is still another object of the present invention to provide a compressor refrigerator having a vapor-liquid separator which is capable of preventing the mist-up phenomenon.

To achieve this aim, the present invention provides a compressor refrigerator comprising: a vapor-liquid separator installed outside the shell of an evaporator, the interior of the vapor-liquid separator being communicated with the inside of the evaporator shell through an opening; an eliminator for vapor-liquid separation disposed within the vapor-liquid separator; and a compressor connected to the side surface of the vapor-liquid separator, so that the refrigerant vapor which is evaporated within the evaporator shell is introduced to the vapor-liquid separator through the opening, is passed through the eliminator to separate droplets and is thereafter sucked by the compressor.

BRIEF DESCRIPTION OF THE DRAWINGS

FIGS. 1, 2, 3, 4, 5 and 6 show a first embodiment of the present invention, wherein FIG. 1 is an elevational view with a partially sectional view of the embodiment;

FIG. 2 is a plan view with a partially sectional view of the embodiment shown in FIG. 1;

FIG. 3 is a sectional view of the embodiment shown in FIG. 2, taken along the line III—III;

FIGS. 4 and 5 are sectional views of the embodiment, taken along different lines; and FIG. 6 is a sectional view of the embodiment shown in FIG. 2, taken along the line VI—VI;

FIGS. 8, 9, and 10 show a third embodiment of the present invention, wherein FIG. 8 is an elevational view with a partially sectional view;

FIG. 9 is a sectional view taken along the line IX—IX; and

FIG. 10 is a perspective view of the plate used for the third embodiment.

DESCRIPTION OF THE PREFERRED EMBODIMENTS

Figure 1:
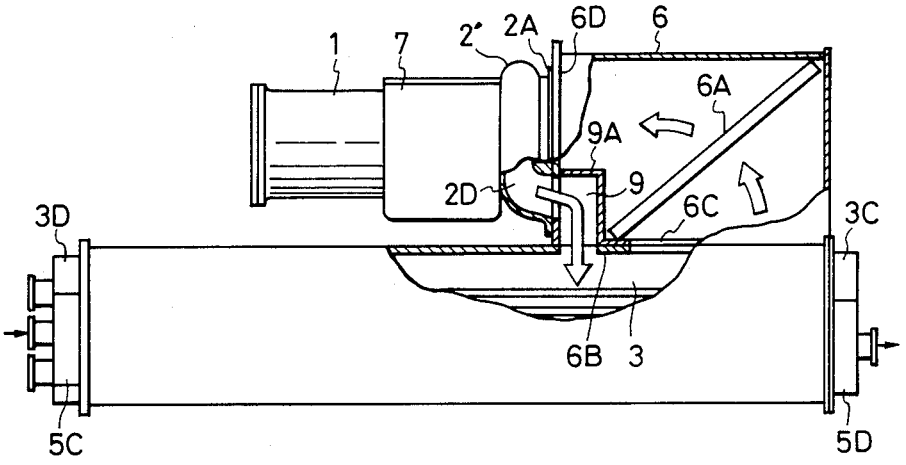
Figure 2:
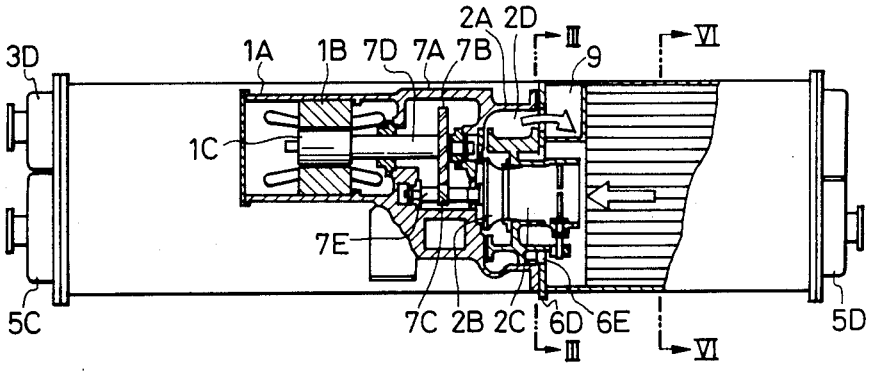
Figure 3:
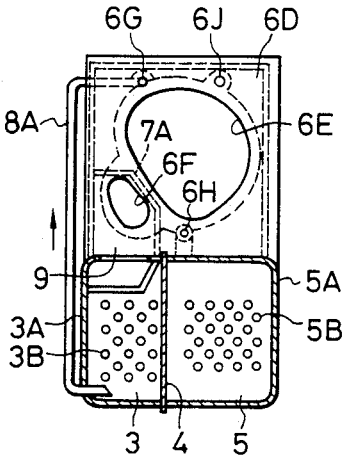
Figure 4:
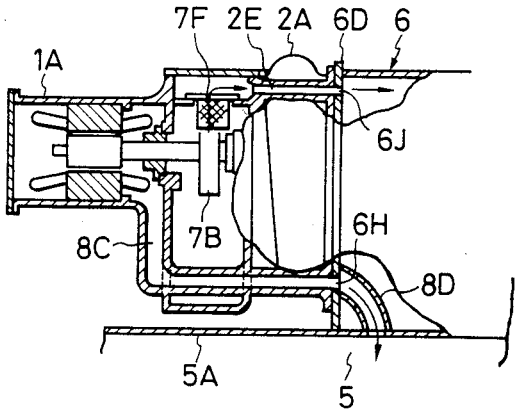
Figure 5:
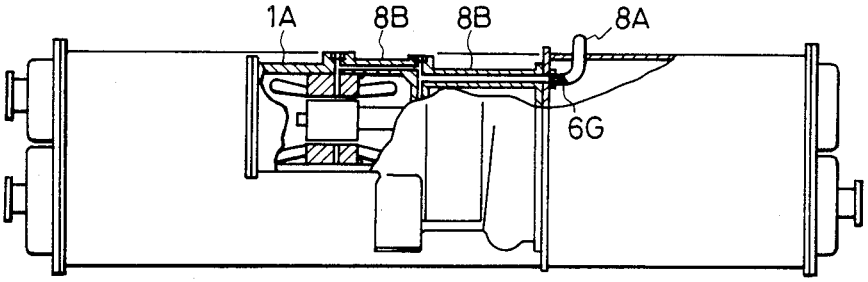

FIGS. 1, 2, 3, 4, 5 and 6 show a first embodiment of the invention which is applied to a turbo-refrigerating machine.

The turbo-refrigerating machine is composed of a motor 1, a turbocompressor 2 which is driven by the motor 1, a condenser 3, a pressure reducing means 4, an evaporator 5, a vapor-liquid separator 6, a set-up gear 7, and a cooling system 8 for the motor 1. The motor 1 has a housing 1A, a stator 1B, and a rotor 1C. The turbocompressor 2 has a casing 2A and an impeller 2B; a suction passage 2C and a discharge passage 2D are provided in the interior of the casing 2A. A passage 2E for collecting refrigerant vapor is also provided in the casing 2A.

The set-up gear 7 is composed of a gear casing 7A, a gear 7B and a pinion 7C. The gear 7B is secured to a shaft 7D which is secured to the rotor 1C of the motor 1, and is meshed with the pinion 7C. The pinion 7C is secured to a shaft 7E, to which the impeller 2B is fixed. The interior of the gear casing 7A is communicated into the passage 2E through an oil mist filter 7F.

The condenser 3 is composed of a shell 3A, a plurality of heat exchanger tubes 3B, a cooling water chamber 3C and a cooling water chamber 3D having an inlet and outlet.

Figure 6:
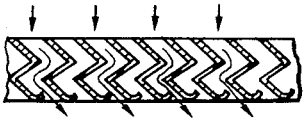

The evaporator 5 is adjacent to a shell 3A of the condenser 3, and is composed of a shell 5A, a group of heat exchanger tubes 5B, a chilled water chamber 5C having an inlet, and a chilled water chamber 5D having an outlet. The rectangular parallelepiped vapor-liquid separator 6 is mounted on the shells 3A and 5A, and is communicated with the interior of the shell 5A through a first opening 6C. The vapor-liquid separator 6 has an element (eliminator) 6A built-in. Since a separation element in general use is usable as the element 6A, detailed explanation will be omitted here. One composed of zigzag plates arranged as shown in FIG. 6 may be used. The separation element 6A is disposed obliquely such as to pass from the vicinity of the upper righthand corner to the vicinity of the lower lefthand corner, as viewed in FIG. 1, of the vapor-liquid separator 6.

The vapor-liquid separator 6 is provided with the first opening 6C on the bottom wall 6B, and a second opening 6E, a third opening 6F, a fourth opening 6G, a fifth opening 6H, and a sixth opening 6J on a side wall 6D. The third opening 6F is connected to the interior of the shell 3A of the condenser 3 through a discharge duct 9 which is separated from the vapor-liquid separator 6 by a wall 9A.

The turbocompressor 2 is installed on the shells 3A and 5A, with a flange portion 2A' secured to the side wall 6D of the vapor-liquid separator 6.

In this state, the suction passage 2C of the turbocompressor 2 is in alignment with the second opening 6E, and the discharge passage 2D with the third opening 6F, respectively.

The cooling system 8 of the motor 1 is composed of a refrigerant liquid introduction tube 8A, a refrigerant liquid introduction passage 8B, a refrigerant discharge passage 8C and a refrigerant discharge tube 8D. One end of the refrigerant liquid tube 8A opens into the bottom portion of the shell 3A of the condenser 3, and the other end is connected to the fourth opening 6G. The refrigerant liquid introduction passage 8B and the refrigerant discharge passage 8C are provided in the casing 2A of the compressor 2, the gear casing 7A of the set-up gear 7 and the housing 1A of the motor 1.

One end of the refrigerant discharge tube 8D is connected to the fifth opening 6H, and the other end opens into the interior of the shell 5A of the evaporator 5. When the turbocompressor 2 is connected to the side wall 6D, as described above, the positions of the suction passage 2C and the second opening 6E, the positions of the discharge passage 2D and the third opening 6F, the positions of the refrigerant introduction passage 8B and the fourth opening 6G, the positions of the refrigerant discharge passage 8C and the fifth opening 6H, and the positions of the passage 2E and the sixth opening 6J, respectively, come into alignment and communicate with each other. As a result, the refrigerant liquid in the condenser 3 flows into the refrigerant liquid introduction tube 8A, the fourth opening 6G, the refrigerant liquid introduction passage 8B and the housing 1A, cools the motor, and thereafter flows into the refrigerant discharge passage 8C, the fifth opening 6H, and the refrigerant discharge tube 8D, finally entering the evaporator 5. The gear casing 7A of the set-up gear 7 is communicated with the interior of the vapor-liquid separator 6, namely, the suction passage 2C of the compressor 2 through the filter 7F, the passage 2E, and the sixth opening 6J, and causes the compressor 2 to absorb the refrigerant vapor which has leaked into the gear casing 7A.

The operation will now be explained.

The refrigerant vapor compressed by the compressor 2 flows into the shell 3A of the condenser 3 through the discharge passage 2D, the third opening 6F, and the discharge duct 9, consecutively. The refrigerant vapor is cooled and liquefied into refrigerant liquid in the condenser shell 3A by the cooling water which flows within the heat exchanger tubes 3B. The pressure of the refrigerant liquid is reduced by the pressure reducing means 4 and thereafter the refrigerant liquid flows into the shell 5A of the evaporator 5, where it is evaporated and absorbs latent heat from the water which flows within the heat exchanger tubes 3B to produce chilled water.

The refrigerant vapor flows into the vapor-liquid separator 6 through the first opening 6C, and passes through the separation element 6A on the way to the second opening 6E. While it passes through the separation element 6A, the droplets included in the refrigerant vapor are collected by the separation element 6A. The collected refrigerant droplets flow along the separation element 6A toward the lower lefthand corner, as viewed in FIG. 1, and flow from this corner portion into the shell 5A of the evaporator 5. The refrigerant vapor from which the droplets are removed is sucked and compressed by the impeller 2B of the turbocompressor 2 through the second opening 6E and the suction passage 2C.

As is clear from the above description, this embodiment only requires that the portion above the group of heat exchanger tubes 5B of the evaporator 5 has a sufficient space only for the refrigerant vapor to flow, and dispenses with the need to provide a space for preventing the droplets flying from the surface of refrigerant liquid from directly adhering to the separation element, which space is essential in the prior art. Accordingly, the distance between the surface of the refrigerant liquid in the evaporator and the diaphragm 5A' at the upper wall of the shell 5A can be reduced to less than half.

Figure 7:
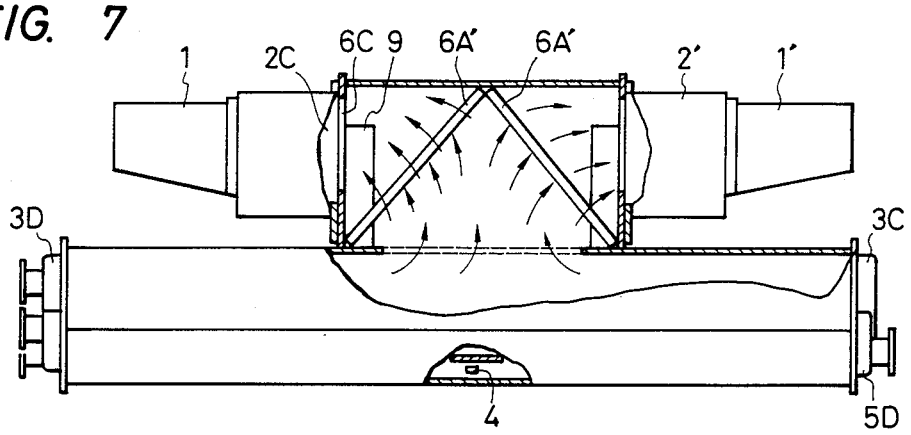
FIG. 7 is an elevational view of a second embodiment of the present invention.

FIG. 7 shows a second embodiment of the present invention.

In the first embodiment a vapor-liquid separator is installed at the end of the shell of an evaporator and one compressor is connected to the vapor-liquid separator, but when the length of a shell is large or the capacity of a refrigerating machine is large, it is more effective for the vapor-liquid separator to be installed in the vicinity of the center of the shell, compressors 1 and 1' to be connected to both sides of the vapor-liquid separator, and separation elements 6A' to be arranged in the configuration of an inverted V, as is shown in FIG. 7. Other parts of the structure are the same as in the first embodiment.

Figure 8:
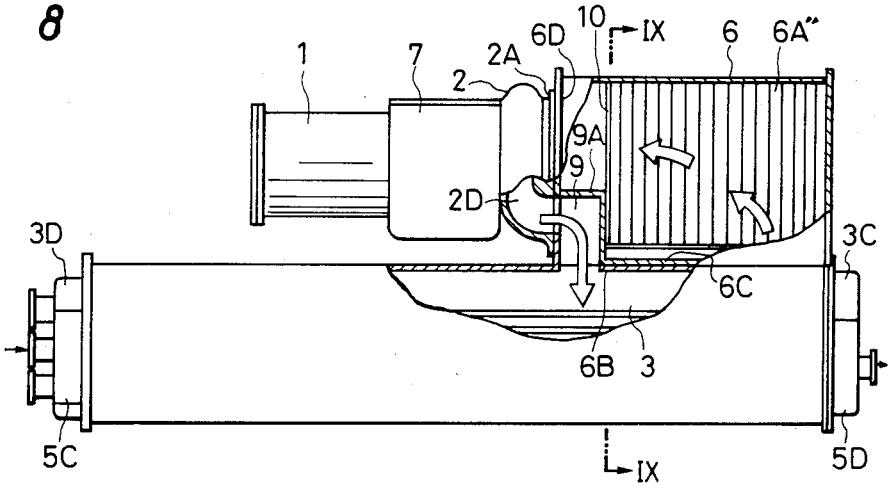
Figure 9:
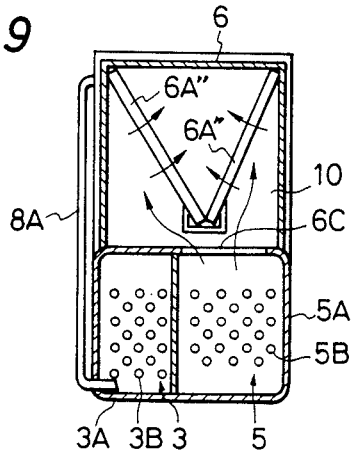
Figure 10:
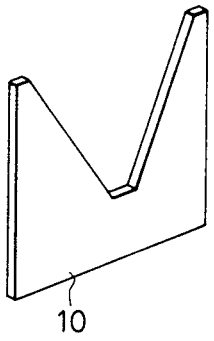

FIGS. 8, 9 and 10 show a third embodiment of the invention.

In this embodiment, two separation elements 6A" are arranged in a V-shape disposed transversely to the separator 6. Other parts of the structure are the same as in the first embodiment.

A plate 10 such as that shown in FIG. 10 is disposed at the side of one end of the separation elements 6A" facing the compressor.

The refrigerant vapor evaporated in the shell of the evaporator 5 passes through the opening 6C, flows into the separation elements 6A" from both sides thereof and flows toward the space surrounded by the separation elements 6A". At this time, the refrigerant vapor proceeds in the separation element 6A" in a zigzag fashion, as is shown in FIG. 6, whereby the droplets included in the refrigerant vapor are removed therefrom. The removed refrigerant droplets flow downwardly along the separation elements 6A", and drop from the lower end portion of the separation elements 6A" into the evaporator shell.

The refrigerant vapor from which the droplets are removed is sucked by the compressor 2 through the opening 6D.

This embodiment can increase the area of the separation element 6A" and hence further reduce the speed at which refrigerant vapor passes.

As is described above, according to the invention, a vapor-liquid separator with a built-in separation element is installed on the outside of an evaporator. As a result the shell of the evaporator requires only a space (in the vertical direction) for refrigerant vapor to flow, and dispenses with the need to provide a space (in the vertical direction) for preventing the droplets flying from the surface of refrigerant liquid from directly adhering to the separation element, the latter being essential in the prior art. In other words, it is possible to reduce by the same extent the height of the shell of the evaporator.

Furthermore, since a compressor is disposed next to the side surface of the vapor-liquid separator, the installation of the vapor-liquid separator outside the evaporator shell does not at all increase the height from the bottom of the evaporator shell to the upper end of the compressor. Accordingly, it is possible to reduce the overall height of a refrigerating machine.

In addition, the sole connection of the compressor 2 to the side wall 6D of the vapor-liquid separator 6 can simultaneously achieve the respective communications between the suction passage 2C of the compressor 2 and the evaporator 5, the discharge passage 2D and the condenser 3, the housing 1A of the motor 1 and the bottom portion of the shell 3A of the condenser 3, the housing 1A of the motor 1 and the evaporator 5, and the gear casing 7A of the set-up gear 7 and the suction passage 2C of the compressor 2.

What is claimed is:

1. A compressor refrigerating machine with a vapor-liquid separator which has an evaporator having a shell and heat exchanger tubes, a condenser having a shell and heat exchanger tubes, a pressure reducing means, a compressor having a suction passage and a discharge passage and being installed on the shells of said evaporator and said condenser, and a motor for driving said compressor, said compressor refrigerating machine comprising:

a vapor-liquid separator connected to the upper portion of said shell of said evaporator, having a first opening on the bottom wall surface thereof, and at least a second opening on at least one side wall surface thereof;

said first opening connecting the interior of said vapor-liquid separator and the interior of the evaporator shell;

said second opening connecting the interior of said vapor-liquid separator and said suction passage of said compressor;

said vapor-liquid separator being provided therewithin with an element member for separating vapor from liquid; and said element member being disposed across the flow of the refrigerant vapor which flows from said first opening toward said second opening in said vapor-liquid separator.

2. A compressor refrigerating machine with a vapor-liquid separator according to claim 1, wherein said compressor is connected to one side wall surface of said vapor-liquid separator by flanges.

3. A compressor refrigerating machine with a vapor-liquid separator according to claim 2, wherein said vapor-liquid separator is a substantially rectangular parallelepiped and said element member is placed between one corner of said vapor-liquid separator and the corner opposing said corner.

4. A compressor refrigerating machine with a vapor-liquid separator according to claim 2, wherein said element member is composed of two elements arranged in a V-shape.

5. A compressor refrigerating machine with a vapor-liquid separator according to claim 2, wherein said element member is composed of two elements arranged in an inverted V-shape.

6. A compressor refrigerating machine with a vapor-liquid separator according to claim 2, wherein said element member is composed of two elements arranged in an inverted V-shape, said second opening is provided on both side wall surfaces of said vapor-liquid separator, and said compressor is connected to both side wall surfaces of said vapor-liquid separator by flanges.

7. A compressor refrigerating machine with a vapor-liquid separator which has an evaporator having a shell and heat exchanger tubes, a condenser having a shell and heat exchanger tubes, a pressure reducing means, a compressor having a suction passage and a discharge passage and being installed on the shells of said evaporator and said condenser, and a motor for driving said compressor, said compressor refrigerating machine comprising:

a vapor-liquid separator connected to the upper portion of said shell of said evaporator, having a first opening on the bottom wall surface thereof, and at least second and third openings on at least one side wall surface thereof;

said first opening connecting the interior of said vapor-liquid separator and the interior of the evaporator shell;

said second opening connecting the interior of said vapor-liquid separator and said suction passage of said compressor;

said vapor-liquid separator being provided therewithin with a discharge duct for connecting said third opening to the interior of the condenser shell;

said third opening and said discharge duct connecting said discharge passage of said compressor and the interior of said condenser shell;

said vapor-liquid separator being provided therewithin with an element member for separating vapor from liquid; and said element member being disposed across the flow of the refrigerant vapor which flows from said first opening toward said second opening in said vapor-liquid separator.

8. A compressor refrigerating machine with a vapor-liquid separator according to claim 7, wherein said compressor is connected to one side wall surface of said vapor-liquid separator by flanges.

9. A compressor refrigerating machine with a vapor-liquid separator according to claim 8, wherein said vapor-liquid separator is a substantially rectangular parallelepiped and said element member is placed between one corner of said vapor-liquid separator and the corner opposing said corner.

10. A compressor refrigerating machine with a vapor-liquid separator according to claim 8, wherein said element member is composed of two elements arranged in a V-shape.

11. A compressor refrigerating machine with a vapor-liquid separator according to claim 8, wherein said element member is composed of two elements arranged in an inverted V-shape.

12. A compressor refrigerating machine with a vapor-liquid separator according to claim 8, wherein said element member is composed of two elements arranged in an inverted V-shape, said second opening is provided on both side wall surfaces of said vapor-liquid separator, and said compressor is connected to both side wall surfaces of said vapor-liquid separator by flanges.

13. A compressor refrigerating machine with a vapor-liquid separator comprising:

an evaporator having a shell and heat exchanger tubes;

a condenser having a shell and heat exchanger tubes;

a pressure reducing means;

a compressor having a casing with a flange portion, a suction passage and a discharge passage;

a motor having a housing, a stator and a rotor;

a set-up gear mechanism having a gear casing, a gear, a pinion and a refrigerant vapor collecting passage; and a cooling system having a refrigerant liquid introduction tube, a refrigerant liquid introduction passage, a refrigerant discharge passage, and a refrigerant discharge tube;

said compressor being installed on the shells of said evaporator and said condenser;

said evaporator being provided with a vapor-liquid separator connected to the upper portion thereof;

said vapor-liquid separator having a first opening on the bottom wall surface thereof, and second, third, fourth, fifth and sixth openings on one side wall surface thereof;

said first opening connecting the interior of said vapor-liquid separator and the interior of the evaporator shell;

said second opening connecting the interior of said vapor-liquid separator and said suction passage of said compressor;

said vapor-liquid separator being provided therewithin with a discharge duct for connecting said third opening to said interior of the condenser shell;

said third opening and said discharge duct connecting said discharge passage of said compressor and the interior of said condenser shell;

said vapor-liquid separator being provided therewithin with an element member for separating vapor from liquid;

said element member being disposed across the flow of the refrigerant vapor which flows from said first opening toward said second opening in said vapor-liquid separator;

one end of said refrigerant vapor collecting passage being connected to the interior of said gear casing and the other end thereof to said sixth opening;

one end of said refrigerant liquid introduction tube being connected to the bottom portion of said shell of said condenser, and the other end thereof to said fourth opening;

said refrigerant liquid introduction passage being extended from said flange portion of said compressor to the interior of said housing of said motor;

said refrigerant discharge passage being extended from said interior of said housing to said flange portion of said compressor;

one end of said refrigerant discharge passage being connected to said fifth opening, and the other end thereof to the interior of said evaporator; and said flange portion of said compressor being connected to side wall of said vapor-liquid separator, thereby communicating said second opening with said suction passage of said compressor, said third opening with said discharge passage of said compressor, said fourth opening with said refrigerant liquid introduction passage, said fifth opening with said refrigerant discharge passage, and said sixth opening with said refrigerant vapor collecting passage, respectively.

14. A compressor refrigerating machine with a vapor-liquid separator according to claim 13, wherein said vapor-liquid separator is a substantially rectangular parallelepiped and said element member is placed between a corner of said vapor-liquid separator and a corner opposing said corner.

15. A compressor refrigerating machine with a vapor-liquid separator according to claim 13, wherein said element member is composed of two elements arranged in a V-shape.

* * * * *